United States Patent [19]

Chikatani

[11] Patent Number: 4,545,185

[45] Date of Patent: Oct. 8, 1985

[54] BINDING APPARATUS FOR PACKING

[75] Inventor: Hajime Chikatani, Hachioji, Japan

[73] Assignee: Kabushiki Kaisha Daisei Kikai, Tokyo, Japan

[21] Appl. No.: 467,173

[22] Filed: Feb. 16, 1983

[30] Foreign Application Priority Data

Feb. 19, 1982 [JP] Japan ..... 57-25656

[51] Int. Cl.[4] ..... B65B 51/08

[52] U.S. Cl. ..... 53/583; 53/412; 53/417; 53/419

[58] Field of Search ..... 53/583, 138 A, 133, 53/139.3, 138 R, 378, 412, 419, 417

[56] References Cited

U.S. PATENT DOCUMENTS

| | | | |
|---|---|---|---|
| 2,841,935 | 7/1958 | Krueger | 53/583 X |
| 2,882,663 | 4/1959 | Leighton | 53/583 |
| 3,221,468 | 12/1965 | Casey | 53/583 X |
| 3,729,896 | 5/1973 | Lehmann | 53/138 A X |
| 4,398,983 | 8/1983 | Suzuki et al. | 53/412 X |

*Primary Examiner*—Francis S. Husar
*Assistant Examiner*—Steven B. Katz
*Attorney, Agent, or Firm*—Oblon, Fisher, Spivak, McClelland & Maier

[57] ABSTRACT

Apparatus for binding closed the openings of bags in which predetermined lengths of non-adhesive face-applying tape are applied to the adhesive surface of adhesive tape at predetermined intervals, the adhesive surface of the adhesive tape between the predetermined lengths of the non-adhesive face-applying tape is wrapped around the puckered openings of bags to be bound shut, and the predetermined lengths of the non-adhesive face-applying tape and the underlying adhesive tape are thereafter severed so as to divide the predetermined lengths of the non-adhesive face-applying tape into two equal portions, whereby both ends of the adhesive tape binding each successive bag have separate, equally sized portions of the non-adhesive face-applying tape applied thereto.

5 Claims, 8 Drawing Figures

PRIOR INVENTION

BINDING APPARATUS FOR PACKING

OBJECT OF THE INVENTION

The present invention relates to a binding apparatus for packing, which binds materials to be bound such as the opening of plastic bags filled with articles.

BACKGROUND OF THE INVENTION

For example, binding of a bag filled with articles has been already carried out in general by puckering its opening and winding an adhesive tape round there.

In a bag bound by a conventional binding apparatus, however, it was difficult to unpack, because the end faces of an adhesive tape bound were stuck on each other, as shown in FIG. 1. The bag was often broken for unpacking, and it was also difficult that after a pack was unpacked once, the resulting adhesive tape was used to close its opening again.

In order to resolve such defects as observed in a conventional binding, the present applicant has provided a binding method in which binding is carried out by using an adhesive tape for binding, whose end faces are made to be a non-adhesive face, whereby unpacking and rebinding can be easily carried out freely, as shown in FIG. 2. (See: the official gazette of Published unexamined patent application (kokai tokkyo koho), No. 17721/1982)

The present invention is intended to provide a binding apparatus for carrying out such type of binding devised by the present application.

SUMMARY OF THE INVENTION

The binding apparatus for packing, according to the present invention, comprises an adhesive tape feed roller for sending out a binding adhesive tape of a length corresponding to the extent of rotation of the rotor of a binding machine onto the said rotor, a pair of non-adhesive face-applying tape feed rollers which are rotated in proportion to the extent of rotation of the same adhesive tape feed roller to send out a non-adhesive face-applying tape of a given length onto the adhesive face of said adhesive tape, and a cutter for intermittently cutting the rear part of the non-adhesive face-applying tape sent onto the adhesive tape by the pair of said feed rollers. Since both the adhesive tape and the non-adhesive face-applying tape are followed with the rotation of the rotor of the binding machine so as to be sent onto the rotor with accuracy, therefore, such binding for packing that the ends of the adhesive tape after the completion of binding are surely made to be a non-adhesive face, whereby unpacking of a bound package and rebinding are easy to practice, can be achieved with accuracy by the binding machine having this rotor.

The present invention is namely intended to provide an apparatus for automatically binding the portion to be bound of a bag such as its opening, by use of a binding adhesive tape whose ends are made to be a non-adhesive face.

DESCRIPTION OF THE PRESENT INVENTION AND EMBODIMENT

The present invention will be described in detail in accordance with the embodiment shown in FIGS. 3 to 5.

Figure 3:
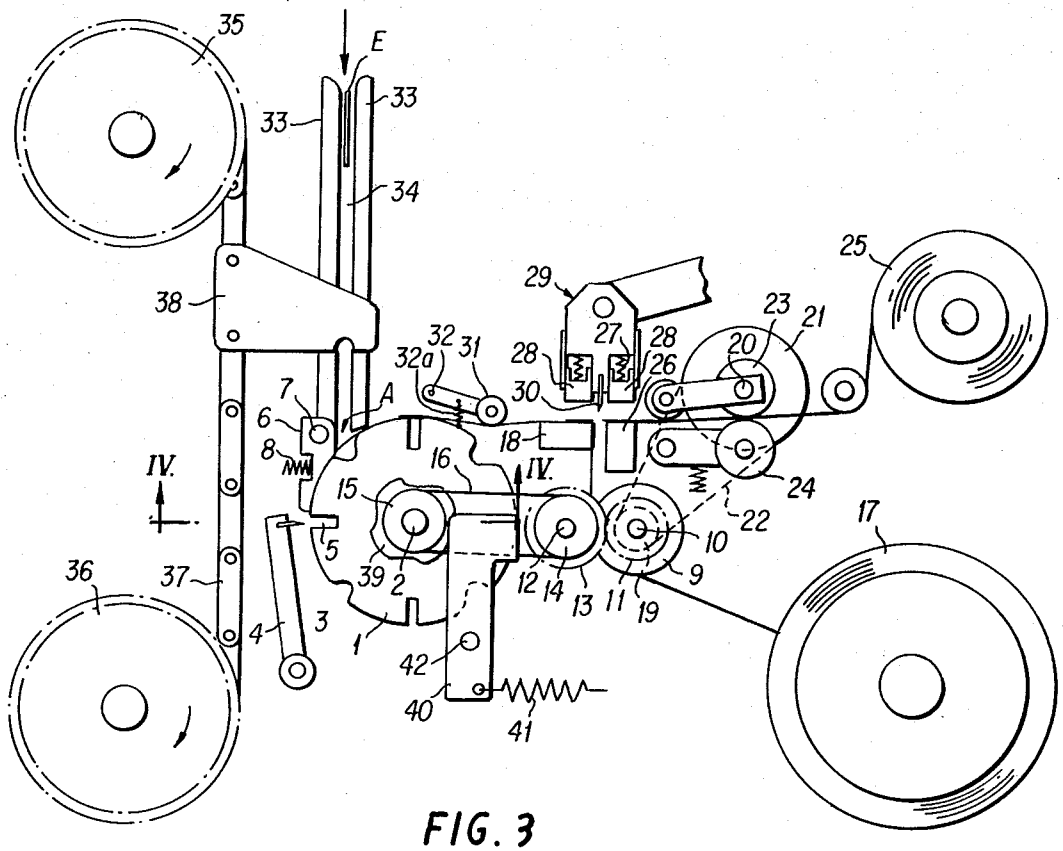
FIG. 3 is a view showing one embodiment of the binding apparatus for packing, according to the present invention.

In FIG. 3, the reference numeral 1 represents a disc-shaped rotor rotatably supported by a shaft 2, and said rotor 1 is provided with four grooves 3 formed at intervals of 90° on its circumference, which receive a material to be bound such as the opening of a puckered bag, and a groove 5 formed between the groove 3 and the groove 3, in which a cutter 4 for cutting an adhesive tape for binding is permitted to go in or out, as mentioned below.

The reference numeral 6 is a catcher pivotally secured on a pin 7 so as to face on the circumference of the rotor 1 and pressed onto the circumference of the rotor 1 by a spring 8, which holds the end of the binding tape when it is wound, as mentioned below. The reference numeral 9 is a feed roller supported by a shaft 10, for sending out the binding adhesive tape onto the circumference of the rotor 1.

The shaft 10 that supports the feed roller 9 has a gear wheel 11 fixed thereon, and the gear wheel 11 gears with a gear wheel 13 fixed on an intermediate shaft 12.

The intermediate shaft 12 has a pulley 14 fixed thereon, and a belt 16 is stretched over between said pulley 14 and a pulley 15 fixed on the shaft 2 supporting the rotor 1.

When the rotor 1 is rotated, therefore, the feed roller 9 is caused to rotate in the same direction of the rotor 1 by way of the pulley 15, belt 16, pulley 14 and gear wheels 13, 11, and the feed roller 9 draws out an adhesive tape from an adhesive tape roller 17, with the adhesive face of the adhesive tape adhering thereon, and sends out it onto the circumference of the rotor 1 through a support 18.

In this case, the quantity of the adhesive tape sent corresponds to the extent of rotation of the rotor 1, because the rotation of the feed roller 9 is given by rotation of the rotor 1.

The shaft 10 has other pulley 19 fixed thereon, and the pulley 19 is connected with a pulley 21 mounted on an upper shaft 20 by a belt 22.

A roller 23 is mounted on the shaft 20 and another roller 24 is rotatably supported under the roller 23, and said rollers 23 and 24 constitute a pair of feed rollers for sending out a non-adhesive face-applying tape.

When the shaft 10 is rotated in correspondence to the rotation of the rotor 1 as mentioned above, accordingly, the roller 23 is caused to rotate in proportion to that rotation so that the roller 23 which constitutes a pair with the roller 24 draws out the tape from a non-adhesive face-applying tape roller 25 and sends it out to the left direction of the drawing.

The reference numeral 26 represents a support placed side by side the support 18, and two pushers 28 are supported by springs 27 over the supports 18 and 26 so that they face to the supports 18 and 26, respectively, and a pushing device 29 with a cutter 30 attached therein is arranged so as to be capable of moving up and down.

The reference numeral 31 is a roller supported swingably around a fulcrum 32, which is pushed down by a spring 32*a* to give deflection to the adhesive tape to be sent to the rotor 1. The reference numeral 33 represents two guide rails arranged in parallel, with a narrow space 34 kept therebetween. Over the guide rails 33, a travelling portion is arranged therealong, and a catching type endless belt or an endless chain with clips is provided here, which sends bags filled with articles in the arrow direction, with catching or gripping their opening, (not shown in the drawing for simplification).

These guide rails 33 act to guide and lead the neck portion of the bags E which are being sent in the arrow direction by the above-mentioned catching type endless belt or endless chain with clips, as they are suspended therefrom.

Figure 4:
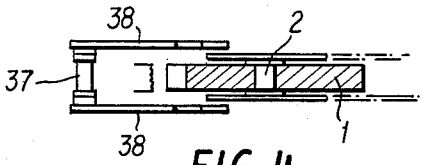
FIG. 4 is a fragmentary sectional view taken along the line IV—IV of FIG. 3.
Figure 5A:
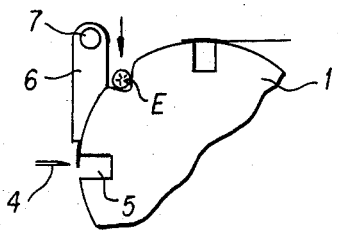
FIGS. 5*a–d* are views showing the binding state carried out by the apparatus shown in FIG. 3.
Figure 5B:
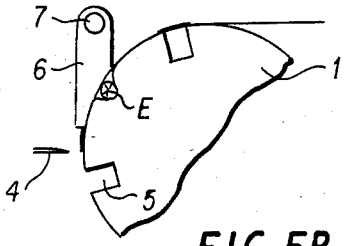
Figure 5C:
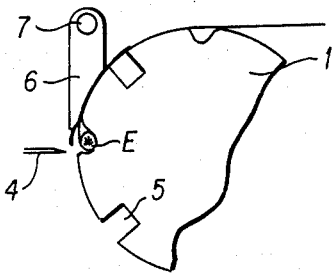
Figure 5D:
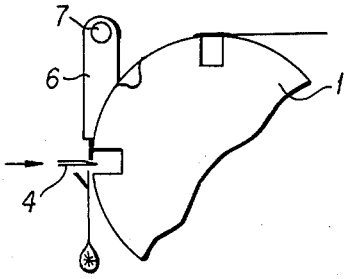

The reference numerals 35 and 36 are chain wheels, and an endless chain 37 is stretched over the same wheels 35 and 36, and puckering plates 38 for a portion to be bound are mounted on the top and bottom of the same chain 37 so that the chain 37 is caught therebetween (FIG. 4).

When the state that the bag E has been conveyed into the guide rails 33 is detected by a photoelectric tube or a limit switch, the chain wheels 35 and 36 are caused to rotate intermittently in the arrow direction, as mentioned hereafter. Accordingly, the to-be-bound portion-puckering plates 38 are moved along the guide rails 33 to gather in the guide rails 33 the opening of the bag that has come into the guide rails 33, and to pucker it, whereby a portion to be bound is formed.

The to-be-bound portion of the bag, thus formed, is sent to the section A by the to-be-bound portion-puckering plates 38 and put into a groove 3 of the rotor 1, and the puckering plates 38 further conveys the to-be-bound portion, with forcedly rotating the rotor 1, as mentioned below.

The reference numeral 39 in the drawing represents a ratchet mounted on the shaft 2 of the rotor 1, and the same ratchet 39 is touching on a rotation retainer 40 pivotally secured on a pin 42 and forced by a spring 41.

The ratchet 39 has four notches, whereby the rotor 1 rotated with the movement of the to-be-bound portion of the bag sent by the puckering plates 38 as mentioned above is intermittently turned just 90° at one time.

Since the apparatus shown in FIG. 3 has the above-mentioned composition, the adhesive tape is partially bonded onto the puckered bag opening E inside the groove 3 of the rotor 1 as shown in FIG. 5(*a*), when the opening E of the bag puckered in the guide rails 33 by the puckering plates 38 is pushed into the section A by the movement of the puckering plates 38, as mentioned above, under the state shown in the drawing. At that time, the adhesive tape is somewhat pulled counterclockwise in the drawing, but that movement of the adhesive tape is allowed by the change of the folding extent of the adhesive tape by the roller 31.

When the bag opening E, as it is in the groove 3, is moved counterclockwise together with the rotor 1 with the movement of the puckering plates 38 under that condition, the adhesive tape is wound round the bag opening E, and the adhesive faces of the same tape are then bonded with each other as shown in FIGS. 5(*b*) and (*c*).

Since the rotor 1 is thus rotated and that rotation is transmitted to the adhesive tape feed roller 9 by way of the pulleys 15, 14 and the gear wheels 13, 11, the adhesive tape of a length corresponding to the extent of rotation of the rotor 1 is sent onto the circumference of the rotor 1 by the feed roller 9.

At the same time, this rotation is also transmitted to the pair of the feed rollers 23 for the non-adhesive face-applying tape, and the non-adhesive face-applying tape of a length shorter than the adhesive tape is drawn out in proportion to the extent of rotation of the rotor 1, and sent onto the adhesive face of the adhesive tape which is being slidingly conveyed on the support 18.

At the time when the adhesive tape and the non-adhesive face-applying tape, each having a given length, have been sent out, the pushing device 29 is dropped so that the tapes are caught between the supports 18, 26 and the pushers 28, and when the pushing device 29 is further dropped, the cutter 30 attached on the pushing device 29 cuts the non-adhesive face-applying tape.

On the support 18, accordingly, the non-adhesive face-applying tape is bonded onto the adhesive face of the adhesive tape, whereby the adhesive face of the adhesive tape is made to be a non-adhesive face partially.

When the bag opening E has been moved from the position (c) to the position (d) in FIG. 5, the adhesive tape on the rotor 1 is made to get into such state that its portion made to be a non-adhesive face partially by bonding the non-adhesive face-applying tape onto the ahdesive face has come over the groove 5 on the rotor 1.

Under that state, the rotor 1 has been rotated only 45°, and it is then stopped by the engagement of the rotation retainer 40 with the ratchet 39. When the rotor 1 has reached that position, the cutter 4 is moved right and inserted into the groove 5 of the rotor 1 so as to cut the adhesive tape in the state that its non-adhesive face is divided into two parts, and the condition on the rotor 1 is turned again into such a state that the adhesive tape in which the non-adhesive face-applying tape has been partially bonded thereon to form a non-adhesive face is arranged as shown in FIG. 3.

In addition, said pushing device 29 is actuated at the same time when the cutter 4 is operated.

Figure 1:
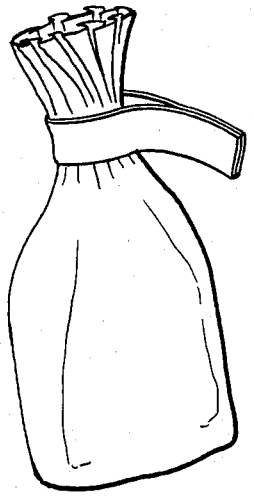
FIG. 1 is a perspective view showing the condition of a package bound by a conventional binding machine.
Figure 2:
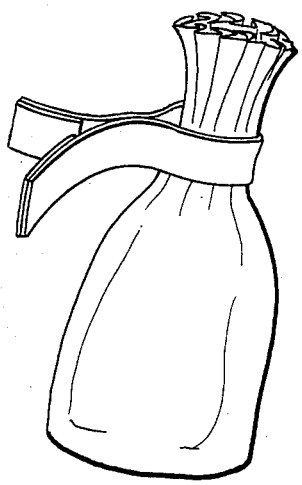
FIG. 2 is a perspective view showing the condition of a package obtained by the apparatus according to the present invention.

Since both the adhesive tape and the non-adhesive face-applying tape are drawn by the rotation of the rotor 1 so as to be fed onto the rotor 1, in this apparatus, the adhesive tape partially given with the non-adhesive face is fed onto the rotor while conformed with the above-mentioned state with accuracy. When the adhesive tape is cut under the condition shown in FIG. 5(*d*), the adhesive tape wound round the bag opening E shuts finally the bag opening E in the state shown in FIG. 2, with both its ends made as the non-adhesive face.

Although the above-mentioned embodiment is, in addition, devised so that the rotation of the rotor 1 is transmitted to the adhesive tape feed roller 9 and the non-adhesive face-applying tape feed roller 23 through the pulley and belt and by way of the engagement of the gear wheels, it is needless to say that other means may be properly selected as these transmitting mechanisms, and that a driving source for the tape feed rollers may be separately adopted and its drive may be further synchronized with the rotation of the rotor 1, when demanded.

The apparatus according to the present invention can be used not only for binding of bags but also for various bindings.

I claim:

1. Apparatus for binding closed the openings of bags, said apparatus comprising:

(a) a rotor rotatable about a central axis, said rotor having a circumferential edge in which are located a plurality of grooves which, during use of the apparatus, receive the puckered openings of bags;

(b) first means for feeding adhesive tape so that it is supported on the circumferential edge of said rotor with its adhesive surface facing outwardly and so that it overlays at least one of said grooves, said first means being operatively connected to said rotor such that a predetermined amount of adhesive tape is used to bind shut the opening of each bag;

(c) second means located adjacent to said rotor for applying a predetermined length of a non-adhesive face-applying tape to the adhesive surface of the adhesive tape at predetermined intervals, thereby rendering the adhesive tape non-adhesive at predetermined intervals, a portion of the predetermined length of non-adhesive face-applying tape being located on each side of said at least one of said grooves when the adhesive tape overlays said at least one of said grooves;

(d) third means located adjacent to said rotor for puckering the openings of bags to be bound shut and for feeding them to said rotor such that the puckered opening of a bag is received in each groove in the circumferential edge of said rotor when the groove is overlayed with adhesive tape and such that the puckered opening of the bag forces the adhesive tape down into the groove;

(e) fourth means located adjacent to said rotor for wrapping the adhesive tape around each successive bag so that the leading edge of the adhesive tape lies adjacent to one of said predetermined lengths of non-adhesive face-applying tape; and (f) fifth means located adjacent said rotor for severing the adhesive tape and the non-adhesive face-applying tape which has been applied to it so as to divide the predetermined length of the non-adhesive face-applying tape into two at least approximately equally sized portions, the leading portion facing the corresponding portion of the non-adhesive face-applying tape on the leading edge of the adhesive tape and the trailing portion of the non-adhesive face-applying tape thereafter constituting the portion of the predetermined length of the non-adhesive face-applying tape on the next successive leading edge of the adhesive tape, which next successive leading edge of the adhesive tape has been created by the severance of the adhesive tape, whereby both ends of the adhesive tape binding each successive bag have separate, at least approximately equally sized portions of the non-adhesive face-applying tape applied thereto.

2. Apparatus as recited in claim 1 wherein the feeding motion of said third means causes said rotor to rotate.

3. Apparatus as recited in claim 1 wherein said third means applies predetermined lengths of the non-adhesive face-applying tape to the adhesive surface of the adhesive tape at the same time that said fifth means severs a preceding section of adhesive tape and non-adhesive face-applying tape.

4. Apparatus as recited in claim 1 wherein there are four symmetrically located grooves located in the circumferential edge of said rotor.

5. Apparatus as recited in claim 1 wherein said second means comprise:

(a) sixth means located adjacent said rotor for intermittently feeding the non-adhesive face-applying tape so as to adhere to the adhesive surface of the adhesive tape before the adhesive tape comes into contact with the rotor and (b) seventh means located adjacent to said rotor for servering the non-adhesive face-applying tape but not the adhesive tape so as to leave the predetermined length of the non-adhesive face-applying tape adhered to the adhesive surface of the adhesive tape.

* * * * *